US006893788B2

(12) United States Patent
Takagi et al.

(10) Patent No.: US 6,893,788 B2
(45) Date of Patent: May 17, 2005

(54) ELECTROPHOTOGRAPHIC TONER, ELECTROPHOTOGRAPHIC DEVELOPER AND IMAGE FORMATION METHOD USING THE SAME

(75) Inventors: Masahiro Takagi, Minamiashigara (JP); Kazuhiko Yanagida, Minamiashigara (JP)

(73) Assignee: Fuji Xerox, Co., Ltd., Tokyo (JP)

( * ) Notice: Subject to any disclaimer, the term of this patent is extended or adjusted under 35 U.S.C. 154(b) by 0 days.

(21) Appl. No.: 10/321,467

(22) Filed: Dec. 18, 2002

(65) Prior Publication Data

US 2003/0175608 A1 Sep. 18, 2003

(30) Foreign Application Priority Data

Dec. 20, 2001 (JP) ..... 2001-387427

(51) Int. Cl.[7] ..... G03G 9/08

(52) U.S. Cl. ..... 430/108.6; 430/108.7; 430/10

(58) Field of Search ..... 430/108.3, 108.7, 430/108.6, 111.4, 109.4

(56) References Cited

U.S. PATENT DOCUMENTS 5,981,121 A * 11/1999 Ide ..... 430/45
6,248,492 B1 * 6/2001 Tavernier et al. ..... 430/120
2002/0142240 A1 * 10/2002 Katagiri et al. ..... 430/108.21
2003/0152787 A1 * 8/2003 Arakawa et al. ..... 428/457

FOREIGN PATENT DOCUMENTS

| | | |
|---|---|---|
| JP | A 1-225978 | 9/1989 |
| JP | A 6-113115 | 4/1994 |
| JP | A 6-122266 | 5/1994 |
| JP | A 6-171198 | 6/1994 |
| JP | A 7-53945 | 2/1995 |
| JP | A 9-77507 | 3/1997 |
| JP | A 9-104857 | 4/1997 |
| JP | A 2001-265181 | 9/2001 |

OTHER PUBLICATIONS

Sicocer P Transparent 17025, BASF, one page. (Feb. 2002).*

* cited by examiner

*Primary Examiner*—Christopher Rodee
(74) *Attorney, Agent, or Firm*—Oliff & Berridge, PLC

(57) ABSTRACT

The present invention provides an electrophotographic toner comprising at least a binder resin and a near-infrared light absorbing material containing inorganic material particles, wherein the rate of absorption in the visible region of the electrophotographic toner is 15% or less and the average dispersion diameter of the near-infrared light absorbing material is in a range from 50 nm to 800 nm. The invention also provides an electrophotographic developer comprising the above photographic toner and a carrier. Further, the invention provides an image forming method using the above electrophotographic toner.

10 Claims, 4 Drawing Sheets

ELECTROPHOTOGRAPHIC TONER, ELECTROPHOTOGRAPHIC DEVELOPER AND IMAGE FORMATION METHOD USING THE SAME

BACKGROUND OF THE INVENTION

1. Field of the Invention

The present invention relates to an electrophotographic toner and an electrophotographic developer that can be preferably used when forming an invisible image together with a visible image on the surface of an image output medium such as recording paper and also relates to an image formation method using these toner and developer.

2. Description of the Related Art

Conventionally, there are attached data embedding technologies for superimposing and embedding attached information in an image. In recent years, utilization of these attached data embedding technologies has been increased, especially for copyright protection for products such as digital books and their still pictures, and for the prevention of illegal copying of these digital books.

When using the attached data embedding technologies for digital books, image data in which attached data such as a copyright ID and a user ID have been embedded are circulated. The data is embedded in such a manner so as to be visually unnoticeable. Diverse measures are incorporated into color image forming devices in order to prevent the forgery of securities and the like. One of these measures includes technologies for superimposing a symbol, which is difficult to visually discern on an image and is unique to the image forming device. The symbol is superimposed on the image data via fixed gradation. This is for identifying the image forming devices used for copying and printing.

When using these technologies, even if securities are forged using an image forming device, the image of the forged product can be read by a reader capable of extracting a specific wavelength region, so that the symbol unique to the image forming device could be deciphered. Therefore, the image forming device used for forging is identified by deciphering this symbol and an effective clue can be obtained to aid in the capture of the forger.

However, the above-mentioned technologies have several problems. Namely, even if a symbol inherent to an image forming device is superimposed in a low density range, it is not reflected on the image density. Hence, the symbol cannot be read. Also, the superimposed symbol inherent to the image forming device can be easily identified by the eye in a density range with high gradation contrast, depending on the gradation characteristics of the image forming device.

Given the situation, various technologies have been taught, for example, the technologies described in Japanese Patent Application Laid-Open (JP-A) Nos. 1-225978, 6-113115, 6-171198 and 6-122266. These disclose well-known technologies for embedding attached information in such a manner so as to be visually unnoticeable.

The technologies described in JP-A No. 1-225978 are for forming an invisible image by forming an electrostatic latent image corresponding to image information on a latent image support, and developing this electrostatic latent image by using an insulation toner having a polarity inverse to that of the electrostatic latent image, and high transparency, to form an invisible toner image. Transferring and fixing the invisible toner image to a transfer material are then carried out. The visualization of the invisible image obtained in this manner is developers containing yellow, magenta and cyan toners to be used for a visible image formed together with the invisible image were supplied to the yellow developing unit 204Y, the magenta developing unit 204M and the cyan developing unit 204C respectively.

The recorded materials obtained by forming an image on the surface of the image output medium by using the above developers are those in which a visible image forming and an invisible image are formed on the image forming surface wherein the visible image comprises a document constituted of characters, pictures and the like formed on the whole of the image forming surface.

In the technologies described in JP-A No. 6-113115, pattern forming devices differing from each other in an image forming system are provided separately to record a given pattern by using a recording material having a characteristic peak of spectral reflection in a wavelength range from 450 nm or less and 650 nm or more.

The technologies described in each of JP-A Nos. 6-171198 and 6-122266 are as follows. Specifically, a color region comprising an infrared absorbing dye and a color region comprising an infrared reflecting dye are formed in parallel or in an overlapped manner on a substrate by using an electrophotographic system, electrostatic recording system or ink jet recording system, to form an image such that at least one of the color regions is used to form an image such as characters, numerals, symbols and patterns and the above two color regions are not substantially discriminable or distinguishable with difficulty by naked eyes.

Also, an image formation method having the same concept as above is described in JP-A No. 2001-265181, which, however, does not refer to an electrophotographic toner in detail.

In the meantime, as image forming materials for forming an invisible image by using materials absorbing near-infrared light, methods utilizing materials containing rare earth metals such as ytterbium are proposed in each of JP-A Nos. 9-104857 and 9-77507. Also, in JP-A No. 7-53945, a method of utilizing an infrared absorbing material containing copper phosphoric acid crystallized glass is proposed.

However, there are the following problems in the conventional technologies described in the above publications. Specifically, the technologies described in JP-A No. 1-225978 have the drawback that when reading the attached information which is the invisible image, a color toner is developed only on the invisible toner portion of the image to visualize the image and therefore the document is denatured once the image is visualized, with the result that after the image is visualized, the image cannot be utilized as a document in which an invisible attached information is embedded.

Also, in the technologies described in JP-A No. 6-113115, nothing is defined concerning the absorptivity of the recording material in the visible region. Therefore, there is the case where it is necessary to dispose a shielding layer for visually shielding the information as the upper layer on the region where the attached information is embedded. Namely, there is the case where the problem arises that the region and image in which the attached information is embedded are limited. Usually, a shielding layer for shielding information visually must absorb or reflect light having all wavelengths in the visible region. In the case of absorbing, the shielding layer is a layer having a black color whereas in the case of reflecting, the shielding layer is a layer having a white color. Therefore, there is the case where the problem arises that the attached information cannot be embedded in any of the region where the visible image is formed. Moreover, when the attached information is visually shielded with the shielding layer having a white color, it is necessary to pad the attached information between the layer on which the visible image is formed and the surface of an image output medium. The problem probably arises that no attached information can be newly added after the above shielding layer is formed.

On the other hand, in the technologies described in each of JP-A Nos. 6-171198 and 6-122266, nothing is defined concerning the absorptivity of the dye which can absorb or reflect infrared rays in the visible region. Therefore, like the above technologies described in JP-A No. 6-113115, the region and image for embedding the attached information are limited and no attached information can be newly added.

Moreover, the technologies described in JP-A No. 6-171198 are used to pad information made of an invisible image in the region where a visible image which is seen as a solid image by the eye is formed. There is therefore the disadvantage that the invisible image cannot be formed on a desired position on the surface of an image output medium irrespective of the position of the visible image formed on the surface of the image output medium.

In also the technologies described in JP-A No. 2001-265181, like the technologies described in the above publication, nothing is defined concerning the absorptivity of the toner forming the invisible image in the visible region and the same problem as above possibly arises.

Because, particularly, almost no studies as to recording materials such as a toner for forming an invisible image have been made in conventional technologies for forming invisible images as aforementioned, there has been the case where various problems arise which include for example, the problem that only an unsatisfactory accuracy is obtained when reading mechanically by infrared radiation as listed above and the problem that various restrictions are imposed when forming an invisible image.

On the other hand, in the conventional technologies described in each of JP-A Nos. 9-104857, 9-77507 and 7-53945 and concerning near-infrared light absorbing materials for forming invisible images, studies on the case of utilizing the near-infrared light absorbing materials as electrophotographic toners for forming invisible images are not made satisfactorily. It is therefore very difficult in practical use to form an invisible image with high accuracy while avoiding the occurrence of the aforementioned various problems listed above by using the technologies described in these publications.

It has been a common practice in recent secret documents and securities that a watermark image, a hologram image or the like is separately recorded as genuine recognition technologies. However, it is cited as a drawback that these measures are very expensive because specific paper and a specific recording method are used and also these measures need excessive labor for the management and protection of secrecy of the paper and recorders to be used.

Also, in technologies for preventing forgery and reproduction in which a specified pattern is formed on the surfaces of secret documents, securities and the like by using a conventional method of forming invisible image, an invisible image is recognized only by mechanical reading, whereby a real article can be discriminated from a forgery article. However, it cannot be, of course, even confirmed with the eye whether or not such an invisible image is present. Unlike, for example, a transparency formed on paper money, it has been impossible to obtain the effect of identifying the real and preventing a forgery simply with the eye.

SUMMARY OF THE INVENTION

The present invention has been made to solve the above problems and it is an object of the invention to provide an electrophotographic toner and an electrophotographic developer, which make it possible to obtain (1) an invisible image enabling stable mechanical reading and decoding treatment by infrared radiation for a long period of time and enabling information to be recorded at high density, (2) an invisible image which can be formed on a desired region regardless of the position where a visible image is formed on the surface of the image output medium and (3) an invisible image which can be identified by a difference in glossiness when viewed with the eye and can produce a forgery preventive effect without impairing the image quality when the visible image formed together with these invisible images is viewed with the eye, on the surface of the image output medium, and also to provide an image formation method using these toner and developer.

The above object is attained by the invention described below. Accordingly, the invention provides an electrophotographic toner comprising at least a binder resin and a near-infrared light absorbing material consisting of inorganic material particles, wherein the rate of absorption in the visible region of the electrophotographic toner is 15% or less, and the average dispersion diameter of the near-infrared light absorbing material is in a range from 50 nm to 800 nm.

In one aspect, the invention may be an electrophotographic toner wherein the binder resin is a resin comprised of a polyester as its major component, and the near-infrared light absorbing material consists of inorganic material particles comprising at least CuO and $P_2O_5$.

Also, the invention provides an image formation method comprising forming at least one invisible image selected from invisible images formed when (a) forming only an invisible image on the surface of an image output medium, (b) forming an invisible image and a visible image by laminating these images one by one on the surface of the image output medium and (c) forming an invisible image and a visible image separately in different regions on the surface of the image output medium, wherein at least one of the invisible images of (a), (b) and (c) is composed of a two-dimensional pattern, wherein the invisible image is formed using the aforementioned electrophotographic toner.

In another aspect, the invention may be an image formation method, wherein the visible image is formed using at least one toner among toners having an absorption rate of 5% or less in the near-infrared light region and possessing a yellow color, a magenta color and a cyan color.

DETAILED DESCRIPTION OF THE PREFERRED EMBODIMENTS

Figure 1:
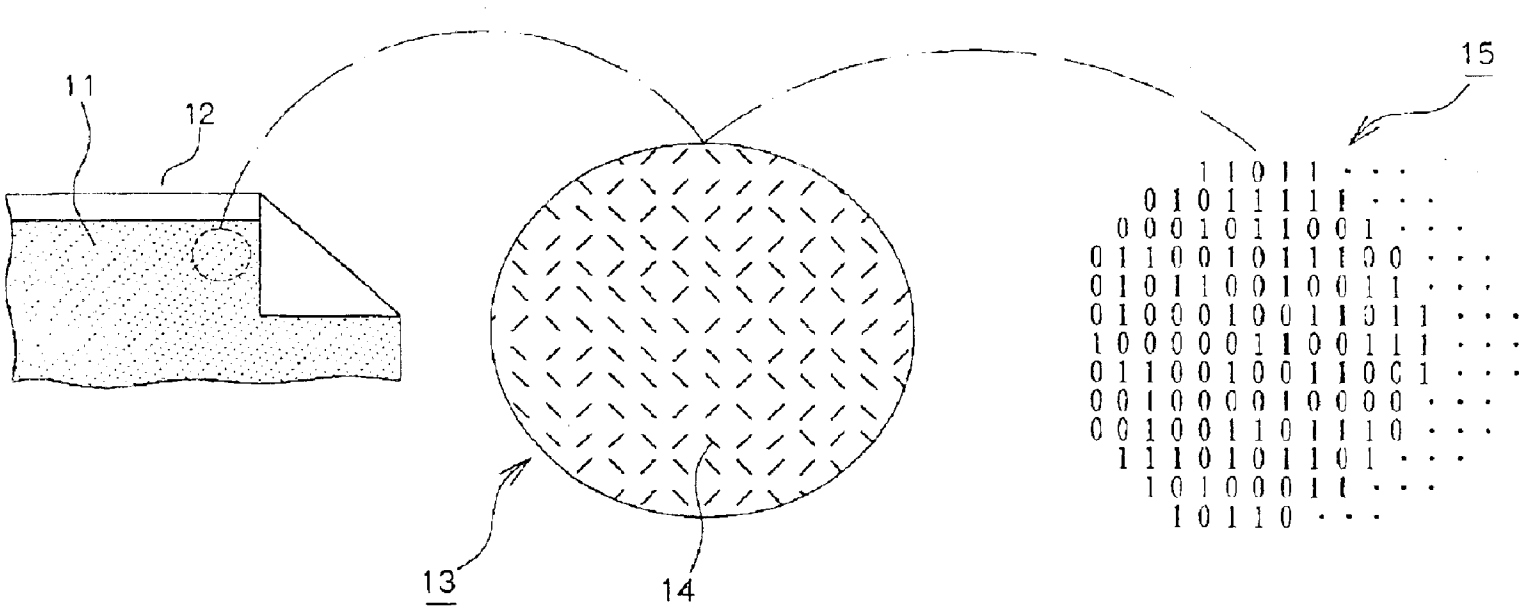
FIG. 1 is a view showing an ordinary image (in the case of viewing with the eye) of a portion where an invisible image composed of a two-dimensional pattern is formed by an image formation method according to the present invention, an enlarged view of the above image when it is recognized by infrared radiation and a typical view showing one example of the cases of capturing the enlarged view as a bit information image after decode-converting the enlarged view into digital information by mechanical reading.

The present invention will be hereinafter explained by largely classifying the invention into five themes represented by an electrophotographic toner, an electrophotographic developer, an image formation method, an embodiment of an invisible image and an embodiment of an image formation method according to the invention by using an image forming device.

Electrophotographic Toner:

The invention is an electrophotographic toner (hereinafter abbreviated simply as "invisible toner" as the case may be) comprising at least a binder resin and an near-infrared light absorbing material containing an inorganic material particle, wherein the rate of absorption in the visible region of the electrophotographic toner is 15% or less and the average dispersion diameter of the near-infrared light absorbing material is in a range from 50 nm to 800 nm.

Since the rate of absorption in the visible region of the electrophotographic toner is 15% or less and the average dispersion diameter of the near-infrared light absorbing material is in a range from 50 nm to 800 nm, an image formed on the surface of an image output medium by the invisible toner can be obtained, which image (1) enables stable mechanical reading and decoding treatment by infrared radiation for a long period of time and information to be recorded at high density, (2) can be formed on a desired region regardless of the position where a visible image is formed on the surface of the image output medium and (3) can be identified by a difference in glossiness when viewed with the eye and can thereby produce a forgery preventive effect without impairing the image quality when the visible image formed together with these invisible images by using the above invisible toner is viewed with the eye, on the surface of the image output medium.

In this case, the maximum absorption rate of the above near-infrared light absorbing material in the visible region (400 nm to 700 nm) must be 15% or less. Further, in order to enhance invisibility on a white paper used usually as an image output medium, the maximum absorption rate in a wavelength range from 400 nm to 600 nm is preferably 8% or less and more preferably 4% or less and, also, the maximum absorption rate in a wavelength range from 600 nm to 700 nm is preferably 10% or less and more preferably 7% or less.

Incidentally, the terms "visible" and "invisible" in the invention mean only whether or not the image formed on the surface of the image output medium can be recognized by the presence or absence of colorability caused by the absorption of light having a specific wavelength in the visible region but do not mean, for example, whether or not the image can be recognized with the eye by a difference in glossiness between the inside and outside of the region of the above image.

When the absorption rate in the visible region exceeds 15%, not only the invisibility of the image formed using the invisible toner is deteriorated so that it is recognized with the eye, but also the quality of the visible image is impaired because the image which must be originally invisible develops a color. Also, in order to evade the occurrence of such a problem, it is necessary to dispose a shielding layer further on the surface of the image formed using an invisible toner and further a visible image thereon, or it is necessary to form an image using the an invisible toner between a visible image which is seen as a black solid image and the surface of the image output medium. Therefore, no image can be formed using an invisible toner irrespective of the position where a visible image is formed on the surface of the image output medium.

On the other hand, the absorption rate of the invisible toner in the near-infrared light region (800 nm to 1000 nm) is preferably 20% or more and more preferably 30% or more from the viewpoint of the reading ability of readers such as CCDs and securing of the accuracy when decoding. Also, it is preferable that the invisible toner have an absorption peak (maximum absorption rate) in a wavelength range from 800 nm to 900 nm at which the optical sensitivity of a CCD is high when a highly accurate image into which more highly densified information is incorporated is formed and this information is read using a CCD.

The absorption rate (near-infrared light absorption rate) of the invisible toner in the near-infrared light region is found as shown in the following formula (1) by using a spectral reflectometer (trade name: V-570, manufactured by JASCO Corporation) to measure the spectral reflectance IT(i) of the image formed using the invisible toner in the near-infrared light region and the spectral reflectance M(i) of the image output medium in the near-infrared light region.

$$\text{Absorption rate of the invisible toner in the near-infrared light region} = IT(i) - M(i) \qquad \text{Formula (1)}$$

Further, by carrying out measurement in the visible region in the same manner as above, the absorption rate (visible absorption rate) of the invisible toner in the visible region can be found. Specifically, the visible absorption rate is found as shown in the formula (2) by measuring the spectral reflectance IT (v) of the image formed using the invisible toner in the visible region and the spectral reflectance M(v) of the image output medium in the visible region.

$$\text{Absorption rate of the invisible toner in the visible region} = IT(v) - M(v) \qquad \text{Formula (2)}$$

Also, the term "average dispersion diameter" means the average particle diameter of an individual near-infrared light absorbing material dispersed in the toner. The average dispersion diameter was found in the following manner by observing the toner by using a TEM (transmission type electron microscope, trade name: JEM-1010, manufactured by Nippon Denshi Datum K.K.): each particle diameter of particulate near-infrared light absorbing materials 1000 in number which were dispersed in the toner was calculated from its sectional area and an average of the measured particle diameters was calculated.

It is necessary that the average dispersion diameter of the near-infrared light absorbing material containing an inorganic material particle is in a range from 50 nm to 800 nm. If the average dispersion diameter falls in the above range, the penetration of a binder resin into the surface of the image output medium can be limited to the extent that fixing ability is not impaired, with the result that the smoothness of the surface of the image formed using the invisible toner is kept higher and the glossiness of that surface is made higher than those of the portion where no image is formed. In this case, when the image formed using the invisible toner is held up to the light at a certain angle, the presence of the position of the image formed by invisible toner having a relatively high glossiness can be recognized without impairing the quality of a visible image.

Further, the average dispersion diameter is preferably in a range from 100 nm to 600 nm and more preferably in a range from 150 nm to 450 nm to enhance near-infrared light absorbing ability necessary for the mechanical reading of the image formed using the invisible toner.

In order to obtain a desired average dispersion diameter within the aforementioned range, an inorganic material particle which has been crushed and granulated in advance such that the particle diameter falls in the above range may be used. Also, the particle diameter of the inorganic material particle may be regulated by controlling the kneading stress in a known toner production method, for example, a melt-kneading method.

When the average particle diameter is less than 50 nm, the obtained image becomes transparent to light also in the infrared region and is blurred with result that the recorded information cannot be read. On the other hand, when the average dispersion diameter exceeds 800 nm, the image quality of the obtained image is deteriorated and a coarse pixel is obtained. Therefore, the density of the recorded information is dropped and the image becomes recognizable easily with the eye, giving rise to the problem that the quality of the visible image is impaired.

No particular limitation is imposed on the near-infrared light absorbing material used for the electrophotographic toner of the invention as far as it is an inorganic material particle which fulfills the requirements as to the absorption rate in the visible region and the average dispersion diameter as already mentioned. However, glass obtained by adding a material, such as a transition metal ion and a dye made of an inorganic and/or organic compound, which absorbs at least light having a wavelength in the near-infrared light region to a known glass network-forming component, such as phosphoric acid, silica and boric acid, which transmits light having a wavelength in the visible region or crystallized glass obtained by crystallizing the above glass by heat treatment may be used.

A known glass network modified component such as other alumina, alkali metal oxides and alkali earth metal oxides may be added to ease the production of the above glass and heat treatment. Also, such glass may be produced by melting raw material once, followed by cooling. However, when it is produced by adding materials such as a dye containing an organic compound, which absorbs light having a wavelength in the near-infrared light region, to glass raw material, it may be produced by, for instance, a sol-gel method enabling the production of the glass without using a melt process requiring heating at high temperatures.

Also, although no particular limitation is imposed on the binder resin used for the electrophotographic toner of the invention as far as it is an inorganic material particle which fulfills the requirements as to the absorption rate in the visible region and the average dispersion diameter as already mentioned, materials such as those listed below may be used.

Homopolymers or copolymers of compounds including styrenes such as styrene and chlorostyrene, monoolefins such as ethylene, propylene, butylene and isoprene, vinyl esters such as vinyl acetate, vinyl propionate, vinyl benzoate and vinyl acetate, α-methylene aliphatic monocarboxylates such as methylacrylate, ethylacrylate, butylacrylate, dodecylacrylate, octylacrylate, phenylacrylate, methylmethacrylate, ethylmethacrylate, butylmethacrylate and dodecylmethacrylate, vinyl ethers such as vinyl methyl ether, vinyl ethyl ether and vinyl butyl ketone and vinyl ketones such as vinyl methyl ketone, vinyl hexyl ketone and vinyl isopropenyl ketone may be exemplified.

Particularly typical examples of the binder resin may include polystyrene, styrene-alkylacrylate copolymers, styrene-alkylmethacrylate copolymers, styrene-acrylonitrile copolymers, styrene-butadiene copolymers, styrene-maleic acid anhydride copolymers, polyethylene and polypropylene. Further, polyesters, polyurethanes, epoxy resins, silicon resins, polyamides, denatured rosin, paraffin and waxes may be exemplified.

As the binder resin and near-infrared light absorbing material constituting the electrophotographic toner of the invention, materials such as those described above are preferably used and the following materials are particularly preferably used.

Namely, it is preferable in the electrophotographic toner that the binder resin be a resin containing polyester as its major component and the near-infrared light absorbing material be an inorganic material particle containing at least CuO and $P_2O_5$.

The use of an inorganic material particle containing at least CuO and $P_2O_5$ as the near-infrared light absorbing material ensures that the image formed using the invisible toner comprising such a near-infrared light absorbing material has more superb invisibility in the visible region and can be recognized more clearly when it is subjected to mechanical reading in the infrared region. It is presumed that the near-infrared light absorbing ability of such an inorganic material particle is exhibited due to near-infrared light absorption of a divalent copper ion contained in the inorganic material.

Particularly, the content of CuO in the invisible toner particle is preferably in a range from 6% by mass to 35% by mass and more preferably in a range from 10% by mass to 30% by mass.

When the content of CuO is less than 6% by mass, there is the case where the near-infrared light absorbing ability is insufficient whereas when the content exceeds 35% by mass, a blue to green tone is intensified and there is therefore the case where the invisibility of the image formed using the invisible toner is impaired.

Moreover, the aforementioned inorganic material particle preferably comprises copper phosphoric acid crystallized glass containing CuO, $Al_2O_3$, $P_2O_5$ and $K_2O$ as its essential structural components with the view of obtaining uniform dispersibility of the inorganic material particle in the invisible toner and moderate negative pole friction charging ability required for a photographic recording material. Preferably, the composition of the copper phosphoric acid crystallized glass is as follows: the content of CuO is in a range from 20% by mass to 60% by mass, the content of $Al_2O_3$ is in a range from 1% by mass to 10% by mass, the content of $P_2O_5$ is in a range from 30% by mass to 70% by mass and the content of $K_2O$ is in a range from 1% by mass to 10% by mass.

The content of CuO is properly adjusted within the above range to obtain appropriate near-infrared light absorbing ability, each content of $P_2O_5$ and $K_2O$ is appropriately adjusted within the above range such that the ratio of the content of the former to the content of the latter meets the requirement for securing the uniformity of the composition of the copper phosphoric acid crystallized glass and the content of $Al_2O_3$ is appropriately adjusted within the above range to stabilize the divalent copper ion.

Examples of a method of producing the copper phosphoric acid crystallized glass having such a composition include a method in which glass raw material in which the above components are mixed is melted at a temperature range from 700° C. to 2000° C. until the mixture becomes uniform and the melted glass raw material is cooled once to the vicinity of ambient temperature to obtain a glassy one, which is then treated under heat at a temperature range from 200° C. to 800° C. to crystallize.

In this case, the glass material is crushed mechanically around the crystallizing treatment to carry out micropowdering treatment. Also, as a preferable measure used for enhancing the near-infrared light absorbing ability of the copper phosphoric acid crystallized glass, the ratio of the presence of the divalent copper ion in the copper crystallized glass is heightened by adding an oxidizer and by carrying out the melt treatment under an oxidizing atmosphere when melting the glass raw material.

In the meantime, as the binder resin, a resin containing a polyester as its major component is preferably used. The use of the resin containing a polyester as its major component is more advantageous than the use of other resins from the viewpoint of the dispersion uniformity and degree of freedom for setting the concentration of the copper phosphoric acid crystallized glass as the near-infrared light absorbing material in the invisible toner particle and from the viewpoint of securing the mechanical strength of the near-infrared absorbing toner particle in the case of compounding the already-mentioned copper phosphoric acid crystallized glass particle to make a toner by a heat-melt kneading and crushing method.

As to the aforementioned polyester resin, particularly a polyester resin synthesized from a polyol component and a carboxylic acid component by polymerization-condensation is preferably used as the binder resin. For example, a linear polyester resin containing a polymerization-condensation product using bisphenol A and polyvalent aromatic carboxylic acid as its major monomer components is preferably used.

It is to be noted that the term "using a polyester as its major component" means that the binder resin comprises only a polyester resin or a mixture of a polyester resin and other resins and the content of the polyester resin contained in the above binder resin is in a range from 70% by mass to 100% by mass.

Examples of the polyol component to be used for the synthesis of the polyester resin include ethylene glycol, propylene glycol, 1,3-butanediol, 1,4-butanediol, 2,3-butanediol, diethylene glycol, triethylene glycol, 1,5-butanediol, 1,6-hexanediol, neopentyl glycol, cyclohexanedimethanol, hydrogenated bisphenol A, bisphenol A-ethylene oxide adducts and bisphenol A-propylene oxide adducts.

Examples of the polycarboxylic acid component include maleic acid, fumaric acid, phthalic acid, isophthalic acid, terephthalic acid, succinic acid, dodecenylsuccinic acid, trimellitic acid, pyromellitic acid, cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methylenecarboxypropanetetramethylenecarboxylic acid and anhydrous materials of these compounds.

As these polyester type binder resins, resins having a softening point range of 90° C. to 150° C., a glass transition temperature range of 55° C. to 75° C., a number average molecular weight range of 2000 to 6000, a mass average molecular weight range of 8000 to 150000, an acid value range of 5 to 30 and a hydroxyl value of 5 to 40 are particularly preferably used from the viewpoint of fixing ability and with the view of imparting glossiness to the image region formed by the invisible toner enabling the production of a forgery preventive effect and the like.

The invisible toner may contain one or more types of wax for regulating fixing characteristics and charge controlling agent for regulating charging as internal additives used by compounding and dispersing in the toner besides the binder resin and the inorganic material particle having near-infrared light absorbing ability.

As the foregoing wax, the following materials may be exemplified. These materials include paraffin wax and its derivatives, montan wax and its derivatives, microcrystalline wax and its derivatives, Fisher-Tropsch wax and its derivatives and polyolefin wax and its derivatives. These derivatives include oxides, polymers with a vinyl monomer and graft modified products. In attached to the above compounds, alcohols, fatty acids, vegetable waxes, animal waxes, mineral waxes, ester waxes and acid amides may be utilized.

The amount of the wax to be added to the invisible toner is preferably in a range from 1% by mass to 10% by mass and more preferably in a range from 3% by mass to 10% by mass. When the amount of the wax to be added is less than 1% by mass, only insufficient fixing latitude (range of the temperature of a fixing roll at which temperature an image is fixed without the offset of a toner) is obtained. On the other hand, the amount exceeds 10% by mass, the dispersion uniformity of the near-infrared light absorbing material is impaired. Also, the powder fluidity of the toner is deteriorated and free wax is stuck to the surface of a light-sensitive body for forming an electrostatic latent image, with the result that the electrostatic latent image cannot be formed exactly.

Also, as the other internal additives, a petroleum type resin may be used to satisfy the requirements for the crushing ability and heat retentivity of the invisible toner. This petroleum type resin is those synthesized using, as starting material, a diolefin or monoolefin contained in the cracking oil by-produced in an ethylene plant producing ethylene, propylene and the like by steam cracking.

Moreover, an inorganic powder and a resin powder may be used independently or in combination as additives to more improve the long term preserving ability, fluidity, developing ability and transfer ability of the invisible toner.

Examples of this inorganic powder include carbon black, silica, alumina, titania and zinc oxide. Examples of the resin powder include globular particles such as PMMA, nylon, melamine, benzoguanamine and fluoro types and powders having an undefined shape such as vinylidene chloride and fatty acid metal salts. The amount of these additives to be added to the invisible toner is preferably in a range from 0.2% by mass to 4% by mass and more preferably in a range from 0.5 to 3% by mass.

Particularly, when an image is formed on the image output medium having high whiteness by using the invisible toner, it is preferable to use a white additive with the intention of more enhancing the invisibility of this image. It is effective to use the aforementioned titania particle as such an additive.

The titania particle can develop the effect of enhancing invisibility even if it is added such that it is contained and dispersed in the inside of the invisible toner and/or added to the surface. It is desirable that the particle diameter of the titania particle be smaller than the average dispersion diameter of the near-infrared light absorbing material. When the particle diameter of the titania particle is larger than the average dispersion diameter of the near-infrared light absorbing material, the whiteness of the invisible toner is increased, whereas the light shielding ability is strengthened and there is therefore the case where the near-infrared light absorbing ability is hindered.

As a method of adding the aforementioned internal additives to the inside of the invisible toner particle, particularly heat-melt kneading treatment is preferably used though known measures may be used. The kneading at this time may be carried out using various heat kneaders. Examples of the heat kneader include a three-roll type, single-shaft screw type, double-shaft screw type and Banbury mixer type.

Also, no particular limitation is imposed on a method of producing the invisible toner and known measures may be used. When the invisible toner particle is produced by crushing the above kneaded product, the product may be crushed using a MICRONIZER, Ulmax, JET-O-Mizer, KTM (Cripton), Turbomie Jet (the above names are all trade names) or the like. Further, as a post-step, mechanical external force is applied using a Hybridization System (manufactured by Nara Machinery Co., Ltd.), Mechano-Fusion System (manufactured by Hosokawamicron Corporation), Criptron System (manufactured by Kawasaki Heavy Industries Ltd.) (the above names are all trade names) or the like, to thereby change the shape of the toner after crushed. Also, examples of the post treatment may involve a step of making a globular particle by hot air. Further, a classifying treatment is carried out to control the size distribution of the toner.

The volume average particle diameter of the invisible toner is preferably in a range from 3 μm to 12 μm and more preferably in a range from 5 μm to 10 μm. When the volume average particle diameter is less than 3 μm, electrostatic adhesive strength is larger than gravitation, bringing about difficult handling as a powder depending on the situation. On the other hand, when the volume average particle diameter exceeds 12 μm, it is difficult to record invisible information exactly depending on the situation.

Electrophotographic Developer:

The electrophotographic developer of the invention is an electrophotographic developer containing a carrier and an electrophotographic toner wherein the electrophotographic toner is preferably the electrophotographic toner of the invention.

The electrophotographic developer of the invention may be obtained by mixing a carrier and the electrophotographic toner of the invention by a known measures. Also, the electrophotographic developer of the invention is preferably a two-component developer prepared by mixing the above electrophotographic toner which is nonmagnetic with a magnetic carrier.

The concentration (TC: Toner Concentration) of the invisible toner in the developer is preferably in a range from 3% by mass to 15% by mass and more preferably in a range from 5% by mass to 12% by mass. The above concentration (TC) of the invisible toner is represented by the following formula.

$$TC\ (\text{wt }\%)=\{\text{Mass of the invisible toner contained in the developer }(g)/\text{Total mass of the developer }(g)\}\times 100.$$

Also, when the charge amount of the invisible toner when the invisible toner is mixed with the carrier to form a developer is too large, the adhesion of the toner to the carrier becomes excessively high and there is therefore the case where such a phenomenon that the invisible toner is not developed occurs. On the other hand, when the charge amount is excessively small, the adhesion of the toner to the carrier is dropped and therefore toner cloud caused by a free toner occurs, posing a problem concerning fogging when forming an image depending on the situation.

Therefore, the charge amount of the invisible toner in the developer is preferably in a range from 5 μC/g to 80 μC/g and more preferably in a range from 10 μC/g to 60 μC/g as absolute value with the view of accomplishing better developing.

As the electrophotographic developer of the invention, those obtained by producing in the following manner may be exemplified.

First, 60% by mass of a polyester resin and 40% by mass of the already mentioned copper phosphoric acid crystallized glass particle were kneaded and crushed to obtain a base toner having an average particle diameter of 9 μm. Next, a hydrophobically treated titania fine powder having an average particle diameter of 40 nm was externally added to the surface of the base toner to obtain a nonmagnetic invisible toner.

As the carrier, a carrier was prepared which was obtained by placing 100 parts by mass of a ferrite particle having an average particle diameter of 50 μm and 1 mass part of a methacrylate resin having a mass average molecular weight of 95,000 together with 500 parts by mass of toluene as a solvent in a pressure kneader, mixing these components at ambient temperature for 15 minutes, then heating the mixture to 70° C. with mixing under reduced pressure to remove the solvent, followed by cooling and screening using a screen having an aperture of 105 μm.

The invisible toner obtained in this manner was mixed with the above carrier such that the toner concentration (TC) was 8 wt % and as a result, an electrophotographic developer of the invention in which the charge amount of the above invisible toner in the developer was made to be 20 μC/g was obtained. However, the electrophotographic developer of the invention is not limited to this example and no particular limitation is imposed on the electrophotographic developer of the invention as far as it contains the electrophotographic toner of the invention and a carrier.

Image Formation Method:

The image formation method of the invention comprises forming at least one invisible image selected from invisible images formed when a) forming only an invisible image on the surface of an image output medium, (b) forming an invisible image and a visible image by laminating these images one by one on the surface of the image output medium and (c) forming an invisible image and a visible image separately in different regions on the surface of the image output medium, wherein at least any of the invisible images of (a), (b) and (c) is composed of a two-dimensional pattern, wherein the invisible image is preferably formed using the electrophotographic toner of the invention.

It is to be noted that the term "invisible image" in the invention means an image which can be recognized by a reader such as CCDs in the infrared region, but cannot be recognized with the eye (namely, invisible) in the visible region because the invisible toner forming the invisible image has no color-developing ability caused by the absorption of a specific wavelength in the visible region.

Also, the term "visible image" means an image which cannot be recognized by a reader such as CCDs in the infrared region, but can be recognized with the eye (namely, visible) in the visible region because the visible toner forming the visible image has color-developing ability caused by the absorption of a specific wavelength in the visible region.

Because the invisible image to be formed using the image formation method of the invention is formed using the electrophotographic toner of the invention, it is possible to carry out mechanical reading and decoding treatment stably for a long period of time and to record information at high density. Also, because the above-mentioned invisible image has no color-developing ability in the visible region and is therefore invisible, it can be formed in a desired region of an image-forming surface whether or not a visible image is formed on the image-forming surface of the image output medium.

In the invention, however, in the case where the visible image region and the invisible image region are overlapped on each other partially or wholly, the invisible image is preferably formed between the visible image and the surface of the image output medium in the region where the visible image and the invisible image are formed with both being overlapped on each other. In such a case, although only the visible image is recognized even if the image forming surface is viewed with the eye from the front side, when viewing with the eye from a slanting direction, the presence of the invisible image can be confirmed without impairing the quality of the visible image by a difference in glossiness between the region where the invisible image is formed and the remainder region.

On the other hand, in the case where the invisible image is formed on the visible image formed on the surface of the image output medium, visible light is shut out by the invisible image, whereby the development of a color in the visible image is prevented, leading to image defects depending on the situation.

Also, by forming the invisible image between the surface of the image output medium and the visible image, the invisible image is protected by the visible image. Therefore, because the invisible image is hard to be deteriorated by, for example, the wear of the image forming surface of the image output medium on which surface the visible image and the invisible image are formed, it is possible to carry out mechanical reading and decoding treatment stably by infrared radiation for a long period of time.

Also, in secret documents, securities and the like which will suffer enormous demerits by the distribution of the forgeries, the information recorded as an invisible image to discriminate the truth is protected by the visible image and it is therefore very difficult to eliminate and to rewrite the foregoing information, whereby a high effect of preventing forgery can be obtained.

Such a way that an invisible image is recognized with the eye by a difference in glossiness is not limited only to the purpose of obtaining the effect of recognizing a real article and preventing forgery, but may be widely utilized in other applications, for example, as a mark for recognizing the position where an invisible information is recorded when reading the information of the invisible image formed at the specified position on the surface of an image output medium by a handy type reader such as a bar code reader.

In the image formation method of the invention, the visible image is preferably formed by at least any one of yellow, magenta and cyan toners which have an absorption rate of 5% or less in the near-infrared light region.

In the case of using an electrophotographic method for the formation of a visible image in the invention, a known toner may be used as the toner used for the formation of the visible image. It is preferable to use yellow, magenta and/or cyan toners (hereinafter abbreviated as "visible toner" as the case may be) which have an absorption rate (near-infrared light absorption rate) of 5% or less in the near-infrared light region with the view of securing an accuracy in the reading of the invisible image.

Although the visible toners may have colors other than yellow, magenta and cyan and may be toners having desired colors such as red, blue and green, it is preferable that a visible toner having any color have a near-infrared light absorption rate of 5% or less.

When the near-infrared light absorption rate of the visible toner exceeds 5%, there is the case where a visible image is also mistaken for an invisible image in the case where an image forming surface on which the invisible image and the visible image are formed on the surface of the image output medium is mechanically read by infrared radiation. Particularly, when the image forming surface is mechanically read without specifying the region where the invisible image is formed and when the invisible image is formed between the visible image and the surface of the image output medium, there is the case where it is difficult to read only the information of the invisible image to decode exactly.

The near-infrared light absorption rate of the visible toner is found as shown in the following formula (3) by using a spectral reflectometer in the same manner as in the case of the already explained invisible toner to measure the spectral reflectance VT(i) of the visible image formed using the visible toner in the near-infrared light region and the spectral reflectance M(i) of the image output medium in the near-infrared light region.

$$\text{Near-infrared light absorption rate of the visible toner} = VT(i) - M(i) \qquad \text{Formula (3)}$$

As typical examples of a colorant used to obtain the visible toner as aforementioned, Aniline Blue, Chalcoil Blue, Chrome Yellow, Ultramarine Blue, DU PONT Oil Red, Quinoline Yellow, Methylene Blue Chloride, Phthalocyanine Blue, Malachite Green Oxalate, Lamp Black, Rose Bengale, C.I. Pigment Red 48:1, C.I. Pigment Red 122, C.I. Pigment Red 57:1, C.I. Pigment Yellow 97, C.I. Pigment Yellow 12, C.I. Pigment Blue 15:1 and C.I. Pigment Blue 15:3 may be given.

Other structural requirements of the visible image forming toner are preferably the same as those in the part relating to the already mentioned invisible toner except for the part relating to the near-infrared light absorbing material and its absorption rate characteristics.

Also, the near-infrared light absorption rate of the invisible toner forming an invisible image is higher than that of the visible toner forming a visible image by preferably 15% or more and more preferably 30% or more to improve an accuracy in the reading of the invisible image.

When a difference in near-infrared light absorption rate between the invisible image and the visible image is less than 15%, there is the case where it is difficult to recognize and read only the invisible image by binary-coding using, as a boundary, a specified contrast (threshold value) to read the invisible image by discriminating the invisible image from others when mechanically reading in the region of the absorption rate between the near-infrared light absorption rate of the invisible image and the near-infrared light absorption rate of the visible image. Specifically, in such a case, there is a possibility of the invisible image being a hindrance to the reading of the invisible image and further to the case of decoding the information recorded in the invisible image exactly.

Such a difference (hereinafter abbreviated simply as "difference in near-infrared light absorption rate" as the case may be) in near-infrared light absorption rate between the invisible toner forming the invisible image and the visible toner forming the visible image is found as shown in the following formula (4) by using a spectral reflectometer to measure the spectral reflectance IP(i) of the visible image (solid image) formed on the surface of the image output medium and the spectral reflectance VP(i) of of the visible image (solid image) formed on the surface of the image output medium.

$$\text{Difference in near-infrared light absorption rate} = IP(i) - VP(i) \quad \text{Formula (4)}$$

Embodiment of the Invisible Image:

Next, the image structure of the invisible image to be formed by the image forming method of the invention, the recognition of the invisible image with the eye, the mechanical reading of the invisible image and the like will be explained in detail.

Although no particular limitation is imposed on the invisible image as far as it is formed using the electrophotographic toner of the invention and can be read mechanically by near-infrared radiation, it may be not only an image of characters, numerals, symbols, patterns, pictures and photographs but also a two-dimensional pattern such as JAN, standard ITF, Code 128, Code 39 and a known bar code called NW-7 and the like.

In the case where the invisible image is made of a two-dimensional pattern such as a bar code, it maybe utilized as a serial number for identifying an image forming device forming an image on an image output medium, a certified number of a copyright of a visible image formed together with the above invisible image on the surface of an image output medium. Also, in the case where the visible image formed together with the invisible image takes the form of secret documents, securities, licenses and personal ID cards, it is also effectively used to detect the identities of the forgeries of these confidential documents.

The aforementioned two-dimensional pattern is not limited to the aforementioned example of a bar code but may be applied to any known recording system without any particular limitation as far as the system has been used for an image which can be visually recognized.

Given as an example of a method of forming a two-dimensional pattern in which microscopic area cells are arranged geometrically is a method of forming a two-dimensional bar code called a QR code. Also, given as an example of a method of forming a two-dimensional pattern in which micro-line bit maps are arranged geometrically is a method of forming a code by plural patterns differing in the angle of rotation as shown by the technologies described in JP-A No. 4-233683.

The formation of the invisible image composed of such a two-dimensional pattern on the surface of the image output medium makes it possible to pad large capacity information, for example, music information and electronic file of a document application soft, in the image in the form which cannot be understood by the eye and it is therefore possible to provide technologies for making higher level secret documents and digital/analogue informations-combined documents.

FIG. 1 is a view showing an ordinary image (in the case of viewing with the eye) of a portion where an invisible image composed of a two-dimensional pattern is formed by an image formation method according to the invention, an enlarged view of the above image when it is recognized by infrared radiation and a typical view showing one example of the cases of capturing the enlarged view as a bit information image after decode-converting the enlarged view into digital information by mechanical reading.

The view shown on the left of FIG. 1 shows the surface of an image output medium 12 when viewed with the eye. An invisible image 11 is formed on the surface of the image output medium 12. It is to be noted that although the invisible image 11 in the figure cannot be visually recognized, it is expressed by a halftone for the convenience of explanations.

Also, the view shown in the center of FIG. 1 is an enlarged view 13 obtained by enlarging the microscopic area of the invisible image 11 in the case of mechanically reading and recognizing the invisible image 11 by infrared radiation. The two-dimensional pattern shown in the enlarged view 13 shows one example of the case where the pattern is formed of plural micro-line bit maps differing in the angle of rotation. Concretely, two kinds of micro-line units 14 having inclinations differing from each other are arranged, wherein one represents a "0" bit information and the other represents a "1" bit information. This two-dimensional pattern composed of these plural micro-line bit maps differing in the angle of rotation is remarkably decreased in noises giving to the visible image and allows massive information to be digitized and embedded therein and is therefore used preferably.

As to the micro-line units 14, one unit is formed of preferably 3 to 10 dots and more preferably 4 to 7 dots. When the one unit is less than 3 dots, mechanical reading errors are increased whereas when the one unit exceeds 10 dots, this causes the appearance of noises to the invisible image and therefore the number of dots out of the above range is undesirable.

The view shown on the right of FIG. 1 is one obtained by capturing the enlarged view 13, in which micro-line units 14 are arranged, as a bit information image 15 by decode-converting the enlarged view into digital information by mechanical reading. As aforementioned, the invisible image is read as the two-dimensional pattern as shown in the enlarged view 13 by a reader such as CCDs and this pattern is decode-converted into the bit information image 15 as digital information. Further, the bit information image 15 is decoded into sound information, documents, image files or electronic files of an application soft in a system corresponding to a recording format at the time of encoding.

In the meantime, there are a method using tissue paper (specific paper from which a character "Copying is prohibited" or the like emerges at the time of optical reading made by a copying machine) and a method in which watermark characters with a relatively pale color are recorded in an overlapped manner as conventional technologies used for forgery preventive technologies. However, all these methods damage the quality of visible images of documents, patterns, designs formed on the surface of the image output medium.

On the other hand, in the case where the invisible image formed on the surface of the image output medium by the image formation method of the invention has glossiness, it is possible to allow the invisible image to be recognized macroscopically when viewing with the eye from a specific angle with the surface of the image output medium and also not to allow the invisible image to be recognized when viewing with the eye from a different angle. Therefore, the quality of a visible image formed together with the invisible image is not impaired. Such an example will be explained below.

Figure 2:
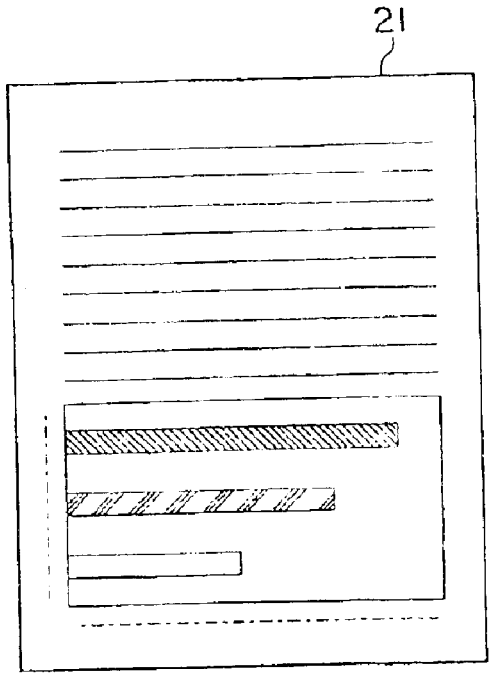
FIG. 2 is one example typically showing an image which can be actually recognized when viewing, with the eye, a recorded material, in which a visible image is formed together with an invisible image on the surface of an image output medium by using an image formation method according to the invention, from a direction (from the front) almost perpendicular to the paper surface of the recorded material.

FIG. 2 is one example typically showing an image which can be actually recognized when viewing, with the eye, a recorded material, in which a visible image is formed together with an invisible image on the surface of an image output medium by using an image formation method according to the invention, from a direction (from the front) almost perpendicular to the paper surface of the recorded material.

Figure 3:
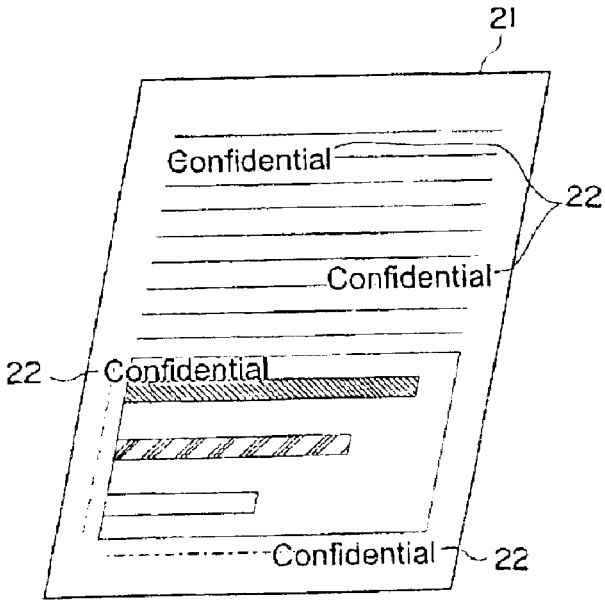
FIG. 3 is one example typically showing an image which can be actually recognized when viewing, with the eye, the recorded material shown in FIG. 2 from a position (from a diagonal direction) deviated from a direction perpendicular to the paper surface of the recorded material.

FIG. 3 is one example typically showing an image which can be actually recognized when viewing, with the eye, the recorded material shown in FIG. 2 from a position (from a diagonal direction) deviated from a direction perpendicular to the paper surface of the recorded material.

In FIG. 2 and FIG. 3, besides a visible image of characters, graphs or the like, an invisible image 22 of a pattern (character) of "Confidential" is formed between the surface of the image output medium and the visible image on the surface of a recorded material 21.

It is shown in FIG. 2 that an invisible image 22 (not shown in FIG. 2) cannot be recognized because it is viewed with the eye from a direction (front side) almost perpendicular to the paper surface of the recorded material 21. On the other hand, it is shown in FIG. 3 that the pattern (character) "Confidential" as the invisible image 22 can be recognized together with the visible image because it is viewed from a position deviated from a direction perpendicular to the paper surface of the recorded material 21 and therefore a difference in glossiness between the region where the invisible image 22 is formed and the remainder region.

In the example shown in FIG. 2 and FIG. 3, the invisible image 22 can be microscopically recognized as a character with the eye. However, the invisible image is not necessarily limited to characters to produce the effect of restraining forging and copying acts. Also, the microscopic area of the invisible image 22 is constituted of a pattern, which can be read mechanically, such as the macro-line unit 14 shown in FIG. 1, whereby the recorded material 21 is made to be more difficult to be forged and to be possible to recognize the real with high accuracy.

It is to be noted that although the invisible image 22 shown in FIG. 3 is recognized by a glossy feel in actual, it is illustrated as a black pattern (character) having no glossy feel for the convenience of explanations because the recorded material formed by the image formation method of the invention is not directly explained with showing it.

On the other hand, the visible image formed together with the invisible image by using the image formation method of the invention may be any image and also, as the image formation method, any known image formation method including an electrophotographic system may be used. However, the near-infrared light absorption rate of the visible image is preferably 5% or less in order to read the invisible image with high accuracy when mechanically reading it. Moreover, although no particular limitation is imposed on the image output medium used in the image formation method of the invention insofar as it allows an image to be formed using the electrophotographic toner of the invention, it is preferably those which do not absorb wavelengths in the near-infrared light region when the invisible image is formed directly on the image output medium and those which are white or have high whiteness when the invisible toner is produced by adding a white pigment such as a titania particle.

As aforementioned, the invisible image composed of a two-dimensional pattern formed on the surface of the image output medium by the image formation method of the invention cannot be seen in a wavelength range exceeding 700 nm, namely invisible to the naked eye and can be read in the near-infrared light region by using a specific measures. As to specific reading means, for example, the image on a recording paper can be read using an image sensor sensitive to infrared light with irradiating the recording paper with illumination having an infrared component.

In the case of the invisible image composed of the aforementioned two-dimensional pattern, highly secret and highly accurate/highly densified information such as a copyright, a symbol for identifying the real, a data link address, an image digital information registration and the like are patterned (encoding) and may be decoded for optical reading in the near-infrared light region according to the need by adopting a specific recording format and incorporating known technologies such as those for providing a cipher key and a parity for reading errors.

Embodiment of the Image Formation Method using an Image Forming Device

The image formation method of the invention will be explained as to an embodiment using an image forming device in detail with reference to the drawings. In the following explanations, an image forming device for forming an invisible image by an electrophotographic method and an image forming device for forming a visible image together with an invisible image at the same time by an electrophotographic method are given as examples of the image forming device; however, the invention is not limited to these examples.

Figure 4:
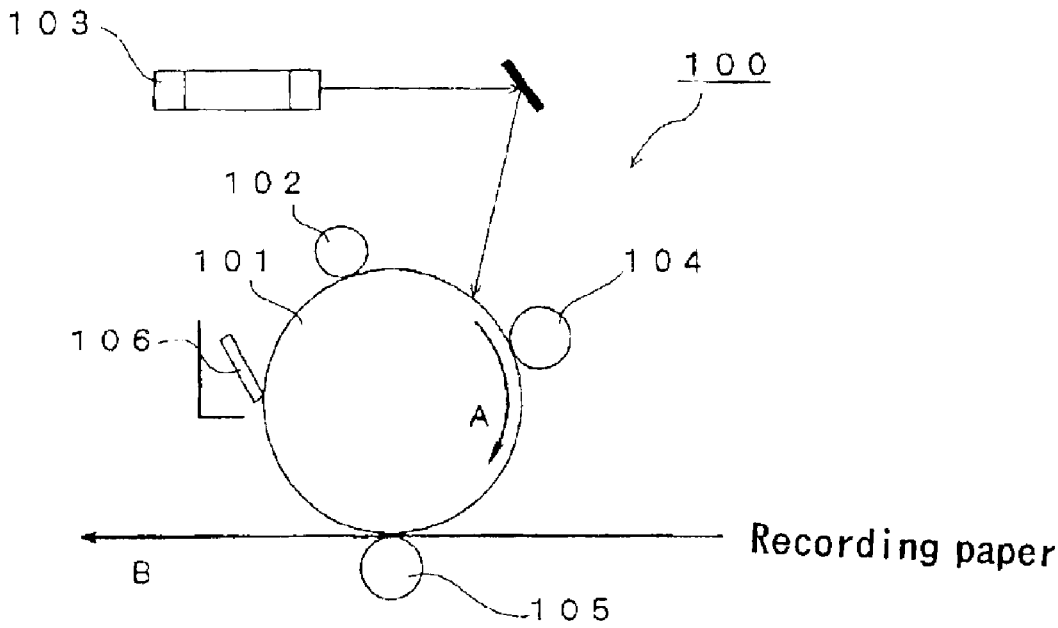
FIG. 4 is a typical view showing an example of the structure of an image forming device for a forming an invisible image by using an image formation method according to the invention.

FIG. 4 is a typical view showing an example of the structure of an image forming device for a forming an invisible image by using the image formation method of the invention. An image forming device 100 shown in the figure is provided with image forming means such as an image support 101, a charger 102, an image writing device 103, a developing unit 104, a transfer roll 105 and a cleaning blade 106.

The image support 101 is formed in a drum form as a whole and has a light-sensitive layer on the outer periphery (drum surface) thereof. This image support 101 is disposed such that it is rotatable in the direction of the arrow A. The charger 102 is used to charge the image support 101 evenly. The image writing device 103 is used to form an electrostatic latent image by irradiating the image support 101 charged evenly by the charger 102 with image light.

The developer 104 stores an invisible toner, supplies this invisible toner to the surface of the image support 101 on which the electrostatic latent image is formed by the image writing device 103 and carries out developing to form a toner image on the surface of the image support 101. The transfer roll 105 is used to transfer the toner image formed on the surface of the image support 101 to a recording paper (image output medium) with sandwiching the recording paper carried in the direction of the arrow B by a paper carrying means (not shown) between itself and the image support 101. The cleaning blade 106 is used to remove the electrophotographic toner left unremoved on the surface of the image support 101 by cleaning after the toner is transferred.

Next, explanations will be furnished as to the formation of an invisible image by using the image forming device 100. First, the image support 101 is driven with rotation and the surface of the image support 101 is evenly charged by the charger 102. Then, the charged surface is irradiated with image light by the image writing device 103 to form an electrostatic latent image. Thereafter, a toner image is formed by the developing unit 104 on the surface of the image support 101 on which surface the electrostatic latent image is formed and then the toner image is transferred to the surface of a recording paper by the transfer roll 105. At this time, a toner left unremoved on the surface of the image support 101 is removed by the cleaning blade 106. An invisible image expressing attached information and the like which are expected to be concealed visually is thus formed on the surface of the recording paper.

It is to be noted that on the surface of the recording paper on which surface the invisible image is formed by the image forming device 100, visible images such as characters, numerals, symbols, patterns, pictures and photographic images may be further recorded by another image forming device. As a method of recording this visible image, a proper method may be arbitrarily selected from not only ordinary printing measures such as offset printing, relief-printing and intaglio printing, but also known image forming technologies such as thermal transfer recording, an ink jet method and an electrophotographic method.

Here, in the case of using an electrophotographic method when the visible image is formed, the invisible image and the visible image are formed continuously whereby technologies superior in productivity and secret manageability can be provided. As to the process flow of image formation in this case, a method generally called a tandem system may be used in which image forming devices storing developers containing toners each containing only an invisible toner, only a yellow toner, only a magenta toner and only a cyan toner respectively are installed such that it is attached to the developer 104 of the image forming device 100 to carry out recording in the image output medium one after another in a superimposing manner.

An invisible image can be formed in a manner that it is embedded between the visible image and the surface of a recording paper by forming the invisible image on the surface of the recording paper and then forming the visible image thereon by using the image forming device shown in FIG. 4.

Figure 5:
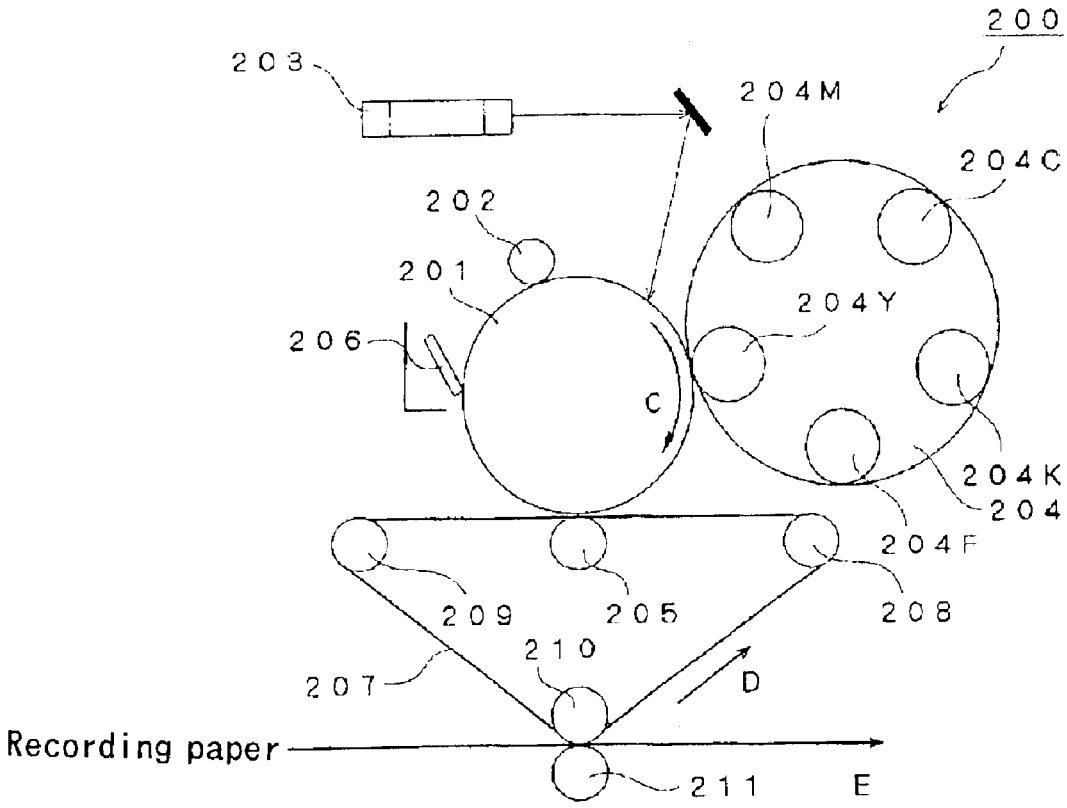
FIG. 5 is a typical view showing an example of the structure of an image forming device for a forming a visible image together with an invisible image by using an image formation method according to the invention.

FIG. 5 is a typical view showing an example of the structure of an image forming device for a forming a visible image together with an invisible image at the same time by using the image formation method of the invention. An image forming device 200 shown in the figure is structured such that it is provided with an image support 201, a charger 202, an image writing device 203, a rotary developing device 204, a primary transfer roll 205, a cleaning blade 206, an intermediate transfer body 207, plural (three in the figure) support rolls 208, 209 and 210, a secondary transfer roll 211 and the like.

The image support 201 is formed in a drum form as a whole and has a light-sensitive layer on the outer periphery (drum surface) thereof. This image support 201 is disposed such that it is rotatable in the direction of the arrow C in the FIG. 5. The charger 202 is used to charge the image support 201 evenly. The image writing device 203 is used to form an electrostatic image by irradiating the image support 201, charged evenly by the charger 202, with image light.

The rotary developing device 204 is provided with 5 developing units 204Y, 204M, 204C, 204K and 204F which store a yellow toner, a magenta toner, a cyan toner, a black toner and an invisible toner respectively. In this device, toners are used as developers for forming an image and therefore the yellow toner, the magenta toner, the cyan toner, the black toner and the invisible toner are stored in the developing units 204Y, 204M, 204C, 204K and 204F respectively. This rotary developing device 204 forms a visible toner image and an invisible toner image wherein the five developing units 204Y, 204M, 204C, 204K and 204F are driven with rotation such that these units are made to be close and opposite to the image support 201 one by one to transfer a toner to an electrostatic latent image corresponding to each color, thereby forming a visible toner image and an invisible toner image.

Here, the developing units other than the developing unit 204F in the rotary developing device 204 may be partially eliminated according to a visible image to be required. For example, a rotary developing device composed of four developing units 204Y, 204M, 204C and 204F is allowed. Also, a developing unit for forming a visible image may be converted into a developing unit storing developers having desired colors such as red, blue and green in actual use.

The primary transfer roll 205 is used to transfer (primary transfer) the toner image (the visible toner image or the invisible toner image) formed on the surface of the image support 201 to the outer peripheral surface of the intermediate transfer body 207 having the form of an endless belt with sandwiching the intermediate transfer body 207 between itself and the image support body 201. The cleaning blade 206 is used to remove a toner left unremoved on the surface of the image support 201 by cleaning after the toner is transferred. The intermediate transfer body 207 is supported such that it is rotatable in the direction of the arrow D and the reverse direction with its internal peripheral surface being hung by plural support rolls 208, 209 and 210. The secondary transfer roll 211 is used to transfer the toner image transferred to the outer peripheral surface of the intermediate transfer body 207 to a recording paper with sandwiching the recording paper (image output medium) carried in the direction of the arrow E by a paper carrying means (not shown) between itself and the support roll 210.

The image forming device 200 is used to form toner images one by one on the surface of the image support 201 and to transfer the toner images on the outer peripheral surface of the intermediate transfer body 207 such that these toner images are overlapped on each other, and works as follows. Specifically, first, the image support 201 is driven with rotation and the surface of the image support 201 is evenly charged by the charger 202. Then, the image support 201 is irradiated with image light by the image writing device 203 to form an electrostatic latent image. This electrostatic latent image is developed by the yellow developing unit 204Y and then the toner image is transferred to the outer peripheral surface of the intermediate body 207 by the primary transfer roll 205. The yellow toner which is not transferred to the recording paper and left unremoved on the surface of the image support 201 is removed by cleaning by the cleaning blade 206. Also, the intermediate transfer body 207 provided with the yellow toner image formed on the outer peripheral surface thereof is moved with rotation once to the reverse of the direction of the arrow D with retaining the yellow toner image on the outer peripheral surface thereof and set to the position where the next magenta toner image is laminated on and transferred to the yellow toner image.

As to also each color of magenta, cyan and black, charging using the charger 202, irradiation with image light by using the image writing device 203, the formation of a toner image by using each of the developing units 204M, 204C and 204K and the transfer of the toner image to the outer peripheral surface of the intermediate transfer body 207 are afterwards repeated in this order.

After the transfer of four color toners to the outer peripheral surface of the intermediate transfer body 207 is finished, the surface of the image support 201 is evenly charged again by the charger 202 in succession to the above process. Then, the surface of the image support is irradiated with image light from the image writing device 203 to form an electrostatic latent image. After the electrostatic latent image is developed by the developing unit 204F for an invisible image and then the obtained toner image is transferred to the outer peripheral surface of the intermediate transfer body 207 by the primary transfer roll 205. Both a full-color image (visible toner image) in which four color toner images are thereby overlapped on each other and an invisible toner image are formed on the outer peripheral surface of the intermediate transfer body 207. These full color visible toner image and invisible toner image are transferred collectively to a recording paper by the secondary transfer roll 211. A recorded image in which the full-color visible image and the invisible image are intermingled is obtained on the image forming surface of the recording paper. Also, in the image formation method of the invention using the image forming device 200, the invisible image is formed between the visible image forming layer and the surface of the recording paper in the region where the visible image and the invisible image are overlapped on each other on the image forming surface.

In the image formation method of the invention using the image forming device 200 shown in FIG. 5, in attached to the same effect that is obtained in the image formation method of the invention using the image forming device 100 shown in FIG. 4, such an effect is obtained that the formation of a full-color visible image and the embedding of attached information by the formation of an invisible image on the surface of a recording paper can be accomplished at the same time.

Also, the invisible image is always placed in the state that it is in contact with the surface of a recording paper by forming the invisible image between the full-color image and the surface of the recording paper. A difference in glossiness caused by the existence of the already mentioned invisible image can be detected by the eye, whereby a forgery preventive effect and the like can be imparted to secret documents and the like.

Moreover, by making the resolution of the invisible image differ from that of the visible image when forming an image, the signals (data) caused by the invisible image can be efficiently separated from the noise signal caused by the visible image to easy the reading of the invisible image by, for example, carrying filtering treatment for cutting frequency components corresponding to the resolution of the invisible image as data processing after reading the invisible image. In this connection, the resolution of these images may be regulated by controlling the writing frequency of the electrostatic latent image in the image writing device 203.

EXAMPLES

The present invention will be hereinafter explained in more detail by way of examples. However, the invention is not limited to the following examples.

These examples will be explained by roughly classifying these examples into a near-infrared light absorbing material used for the production of an invisible toner, the productions of the invisible toner and a developer, the formation of an image by an image forming device, the evaluation of an invisible image and a visible image formed on a recorded material and the evaluation of the absorption rate in this order.

Near-infrared Absorbing Material used to Produce an Invisible Toner

As a near-infrared light absorbing material used to produce an invisible toner, copper phosphoric acid crystallized glasses A to F were used which were produced by crystallizing glasses having the compositions shown in Table 1 by heat treatment and by mechanically crushing the obtained crystal materials until the particle diameter was decreased to about several $\mu$m.

Production of Invisible Toners and Developers

Example 1

A mixture of toner materials including 55 parts by mass of a linear polyester as a binder resin, 40 parts by mass of a copper phosphoric acid crystallized glass A as a near-infrared light absorbing material and 5 parts by mass of a wax (long-chain and straight-chain fatty acid/long-chain and straight-chain saturated alcohol; stearyl behenate) as an additive was kneaded in an extruder and crushed. Thereafter, the crushed mixture was classified into fine grains and coarse grains by a pneumatic classifier to obtain particles having a volume average particle diameter (average particle diameter D50) of 8.6 $\mu$m.

The aforementioned linear polyester was synthesized using terephthalic acid, a bisphenol A-ethylene oxide adduct and cyclohexanedimethanol as raw material and had a glass transition point Tg of 61° C., a number average molecular weight Nm of 4200, a mass average molecular weight Mw of 33000, an acid value of 12 and a hydroxyl value of 25.

Also, the section of the resulting particle was observed by a TEM at a magnification of about 30000, to find that the average dispersion diameter of the near-infrared light absorbing material dispersed in the particle was 320 nm.

Next, 0.7 parts by mass of a rutile type titania particle (average particle diameter: 25 nm) and 0.6 parts by mass of a silica particle (average particle diameter: 40 nm) were externally added as secondary additives to 100 parts by mass of the obtained particle by a HENSCHEL mixer to obtain an invisible toner (toner 1) of Example 1.

As to a carrier, on the other hand, 100 parts by mass of a Nm-Mg ferrite particle (average particle diameter: 40 $\mu$m) was poured into a toluene solution prepared by dissolving 0.8 parts by mass of a styrene-butylmethacrylate copolymer (mass average molecular weight=120000) of which the copolymerization ratio of styrene/butylmethacrylate was 25/75 in 10 parts by mass of toluene. The mixture was dried under vacuum with stirring under heating to obtain a carrier of Example 1 in which the Nm-Mg ferrite particle was coated with the styrene-butylmehtacrylate.

Further, 8 parts by mass of the toner 1 and 100 parts by mass of the above carrier were mixed in a V-blender to obtain a developer (developer 1) of Example 1. Using the developer 1 obtained in this manner, an image formation test was made using an image forming device to make various evaluations.

Example 2

A mixture of toner materials including 52 parts by mass of a linear polyester as a binder resin, 40 parts by mass of a copper phosphoric acid crystallized glass B as a near-infrared light absorbing material and 3 parts by mass of an anatase type titania particle (average particle diameter: 35 nm) as an additive was kneaded in an extruder and crushed. Thereafter, the crushed mixture was classified into fine grains and coarse grains by a pneumatic classifier to obtain particles having a volume average particle diameter of 6.1 $\mu$m.

The aforementioned linear polyester was synthesized using terephthalic acid, a bisphenol A-ethylene oxide adduct, a bisphenol A-propylene oxide adduct and cyclohexanedimethanol as raw material and had a glass transition point Tg of 70° C., a number average molecular weight Nm of 4600, a mass average molecular weight Mw of 38000, an acid value of 11 and a hydroxyl value of 23.

Also, the section of the resulting particle was observed by a TEM at a magnification of about 30000, to find that the average dispersion diameter of the near-infrared light absorbing material dispersed in the particle was 427 nm.

Next, 0.9 parts by mass of a rutile type titania particle (average particle diameter: 25 nm) and 1.0 mass part of a silica particle (average particle diameter: 40 nm) were externally added as secondary additives to 100 parts by mass of the obtained particle by a HENSCHEL mixer to obtain an invisible toner (toner 2) of Example 2.

Further, 8 parts by mass of the toner 2 and 100 parts by mass of the carrier used in Example 1 were mixed in a V-blender to obtain a developer (developer 2) of Example 2. Using the developer 2 obtained in this manner, an image formation test was made using an image forming device to make various evaluations.

Example 3

A mixture of toner materials including 54 parts by mass of a linear polyester as a binder resin and 46 parts by mass of a copper phosphoric acid crystallized glass C as a near-infrared light absorbing material was kneaded in an extruder and crushed. Thereafter, the crushed mixture was classified into fine grains and coarse grains by a pneumatic classifier to obtain particles having a volume average particle diameter of 9.6 $\mu$m.

The aforementioned linear polyester was synthesized using terephthalic acid, a bisphenol A-ethylene oxide adduct, a bisphenol A-propylene oxide adduct and cyclohexanedimethanol as raw material and had a glass transition point Tg of 70° C., a number average molecular weight Mn of 4600, a mass average molecular weight Mw of 38000, an acid value of 11 and a hydroxyl value of 23.

Also, the section of the resulting particle was observed by a TEM at a magnification of about 30000, to find that the average dispersion diameter of the near-infrared light absorbing material dispersed in the particle was 109 nm.

Next, 0.6 parts by mass of a rutile type titania particle (average particle diameter 20 nm) and 0.4 parts by mass of an anatase type titania particle (average particle diameter: 30 nm) were externally added as secondary additives to 100 parts by mass of the obtained particle by a HENSCHEL mixer to obtain an invisible toner (toner 3) of Example 3.

Further, 8 parts by mass of the toner 3 and 100 parts by mass of the carrier used in Example 1 were mixed in a V-blender to obtain a developer (developer 3) of Example 3. Using the developer 3 obtained in this manner, an image formation test was made using an image forming device to make various evaluations.

Example 4

A mixture of toner materials including 67 parts by mass of a linear polyester as a binder resin and 33 parts by mass of a copper phosphoric acid crystallized glass D as a near-infrared light absorbing material was kneaded in an extruder and crushed. Thereafter, the crushed mixture was classified into fine grains and coarse grains by a pneumatic classifier to obtain particles having a volume average particle diameter of 8.8 $\mu$m.

The aforementioned linear polyester was synthesized using terephthalic acid, a bisphenol A-ethylene oxide adduct, a bisphenol A-propylene oxide adduct and cyclohexanedimethanol as raw material and had a glass transition point Tg of 70° C., a number average molecular weight Mn of 4600, a mass average molecular weight Mw of 38000, an acid value of 11 and a hydroxyl value of 23.

Also, the section of the resulting particle was observed by a TEM at a magnification of about 30000, to find that the average dispersion diameter of the near-infrared light absorbing material dispersed in the particle was 59 nm.

Next, 0.7 parts by mass of a rutile type titania particle (average particle diameter: 20 nm) and 0.6 parts by mass of an anatase type titania particle (average particle diameter: 45 nm) were externally added as secondary additives to 100 parts by mass of the obtained particle by a HENSCHEL mixer to obtain an invisible toner (toner 4) of Example 4.

Further, 8 parts by mass of the toner 4 and 100 parts by mass of the carrier used in Example 1 were mixed in a V-blender to obtain a developer (developer 4) of Example 4. Using the developer 4 obtained in this manner, an image formation test was made using an image forming device to make various evaluations.

Example 5

A mixture of toner materials including 60 parts by mass of a linear polyester as a binder resin and 40 parts by mass of a copper phosphoric acid crystallized glass E as a near-infrared light absorbing material was kneaded in an extruder and crushed. Thereafter, the crushed mixture was classified into fine grains and coarse grains by a pneumatic classifier to obtain particles having a volume average particle diameter of 9.5 $\mu$m.

The aforementioned linear polyester was synthesized using terephthalic acid, a bisphenol A-ethylene oxide adduct, a bisphenol A-propylene oxide adduct and cyclohexanedimethanol as raw material and had a glass transition point Tg of 70° C., a number average molecular weight Mn of 4600, a mass average molecular weight Mw of 38000, an acid value of 11 and a hydroxyl value of 23.

Also, the section of the resulting particle was observed by a TEM at a magnification of about 30000, to find that the average dispersion diameter of the near-infrared light absorbing material dispersed in the particle was 525 nm.

Next, 0.6 parts by mass of a rutile type titania particle (average particle diameter: 25 nm) and 0.4 parts by mass of an anatase type titania particle (average particle diameter: 35 nm) were externally added as secondary additives to 100 parts by mass of the obtained particle by HENSCHEL mixer to obtain an invisible toner (toner 5) of Example 5.

Further, 8 parts by mass of the toner 5 and 100 parts by mass of the carrier used in Example 1 were mixed in a V-blender to obtain a developer (developer 5) of Example 5. Using the developer 5 obtained in this manner, an image formation test was made using an image forming device to make various evaluations.

Example 6

A mixture of toner materials including 75 parts by mass of a linear polyester as a binder resin and 25 parts by mass of a copper phosphoric acid crystallized glass E as a near-infrared light absorbing material was kneaded in an extruder and crushed. Thereafter, the crushed mixture was classified into fine grains and coarse grains by a pneumatic classifier to obtain particles having a volume average particle diameter of 6.5 $\mu$m.

The aforementioned linear polyester was synthesized using terephthalic acid, a bisphenol A-ethylene oxide adduct, a bisphenol A-propylene oxide adduct and cyclohexanedimethanol as raw material and had a glass transition point Tg of 70° C., a number average molecular weight Mn of 4600, a mass average molecular weight Mw of 38000, an acid value of 11 and a hydroxyl value of 23.

Also, the section of the resulting particle was observed by a TEM at a magnification of about 30000, to find that the average dispersion diameter of the near-infrared light absorbing material dispersed in the particle was 300 nm.

Next, 0.8 parts by mass of a rutile type titania particle (average particle diameter: 20 nm) and 1.0 mass part of a silica particle (average particle diameter: 35 nm) were externally added as secondary additives to 100 parts by mass of the obtained particle by a HENSCHEL mixer to obtain an invisible toner (toner 6) of Example 6.

Further, 8 parts by mass of the toner 6 and 100 parts by mass of the carrier used in Example 1 were mixed in a V-blender to obtain a developer (developer 6) of Example 6. Using the developer 6 obtained in this manner, an image formation test was made using an image forming device to make various evaluations.

Example 7

A mixture of toner materials including 62 parts by mass of a linear polyester as a binder resin and 58 parts by mass of a copper phosphoric acid crystallized glass D as a near-infrared light absorbing material was kneaded in an extruder and crushed. Thereafter, the crushed mixture was classified into fine grains and coarse grains by a pneumatic classifier to obtain particles having a volume average particle diameter of 5.5 $\mu$m.

The aforementioned linear polyester was synthesized using terephthalic acid, a bisphenol A-ethylene oxide adduct, a bisphenol A-propylene oxide adduct and cyclohexanedimethanol as raw material and had a glass transition point Tg of 70° C., a number average molecular weight Mn of 4600, a mass average molecular weight Mw of 38000, an acid value of 11 and a hydroxyl value of 23.

Also, the section of the resulting particle was observed by a TEM at a magnification of about 30000, to find that the average dispersion diameter of the near-infrared light absorbing material dispersed in the particle was 764 nm.

Next, 1.4 parts by mass of a rutile type titania particle (average particle diameter: 20 nm) and 1.0 mass part of a silica particle (average particle diameter: 70 nm) were externally added as secondary additives to 100 parts by mass of the obtained particle by a HENSCHEL mixer to obtain an invisible toner (toner 7) of Example 7.

Further, 8 parts by mass of the toner 7 and 100 parts by mass of the carrier used in Example 1 were mixed in a V-blender to obtain a developer (developer 7) of Example 7. Using the developer 7 obtained in this manner, an image formation test was made using an image forming device to make various evaluations.

Example 8

A mixture of toner materials including 60 parts by mass of a linear polyester as a binder resin and 40 parts by mass of a copper phosphoric acid crystallized glass G as a near-infrared light absorbing material was kneaded in an extruder and crushed. Thereafter, the crushed mixture was classified into fine grains and coarse grains by a pneumatic classifier to obtain particles having a volume average particle diameter of 6.1 $\mu$m.

The aforementioned linear polyester was synthesized using terephthalic acid, a bisphenol A-ethylene oxide adduct, a bisphenol A-propylene oxide adduct and cyclohexanedimethanol as raw material and had a glass transition point Tg of 70° C., a number average molecular weight Mn of 4600, a mass average molecular weight Mw of 38000, an acid value of 11 and a hydroxyl value of 23.

Also, the section of the resulting particle was observed by a TEM at a magnification of about 30000, to find that the average dispersion diameter of the near-infrared light absorbing material dispersed in the particle was 413 nm.

Next, 0.7 parts by mass of a rutile type titania particle (average particle diameter: 20 nm) and 0.7 parts by mass of an anatase type titania particle (average particle diameter: 35 nm) were externally added as secondary additives to 100 parts by mass of the obtained particle by a HENSCHEL mixer to obtain an invisible toner (toner 8) of Example 8.

Further, 8 parts by mass of the toner 8 and 100 parts by mass of the carrier used in Example 1 were mixed in a V-blender to obtain a developer (developer 8) of Example 8. Using the developer 8 obtained in this manner, an image formation test was made using an image forming device to make various evaluations.

Comparative Example 1

A mixture of toner materials including 70 parts by mass of a linear polyester as a binder resin and 30 parts by mass of a copper phosphoric acid crystallized glass A as a near-infrared light absorbing material was kneaded in an extruder and crushed. Thereafter, the crushed mixture was classified into fine grains and coarse grains by a pneumatic classifier to obtain particles having a volume average particle diameter of 7.5 $\mu$m.

The aforementioned linear polyester was synthesized using terephthalic acid, a bisphenol A-ethylene oxide adduct, a bisphenol A-propylene oxide adduct and cyclohexanedimethanol as raw material and had a glass transition point Tg of 70° C., a number average molecular weight Mn of 4600, a mass average molecular weight Mw of 38000, an acid value of 11 and a hydroxyl value of 23.

Also, the section of the resulting particle was observed by a TEM at a magnification of about 30000, to find that the average dispersion diameter of the near-infrared light absorbing material dispersed in the particle was 47 nm.

Next, 1.0 mass part of a rutile type titania particle (average particle diameter: 20 nm) and 0.8 parts by mass of a silica particle (average particle diameter: 40 nm) were externally added as secondary additives to 100 parts by mass of the obtained particle by a HENSCHEL mixer to obtain an invisible toner (toner A) of Comparative Example 1.

Further, 8 parts by mass of the toner A and 100 parts by mass of the carrier used in Example 1 were mixed in a V-blender to obtain a developer (developer A) of Comparative Example 1. Using the developer A obtained in this manner, an image formation test was made using an image forming device to make various evaluations.

Comparative Example 2

A mixture of toner materials including 60 parts by mass of a linear polyester as a binder resin and 40 parts by mass of a copper phosphoric acid crystallized glass A as a near-infrared light absorbing material was kneaded in an extruder and crushed. Thereafter, the crushed mixture was classified into fine grains and coarse grains by a pneumatic classifier to obtain particles having a volume average particle diameter of 9.1 $\mu$m.

The aforementioned linear polyester was synthesized using terephthalic acid, a bisphenol A-ethylene oxide adduct, a bisphenol A-propylene oxide adduct and cyclohexanedimethanol as raw material and had a glass transition point Tg of 60° C., a number average molecular weight Mn of 3800, a mass average molecular weight Mw of 32000, an acid value of 11 and a hydroxyl value of 23.

Also, the section of the resulting particle was observed by a TEM at a magnification of about 30000, to find that the average dispersion diameter of the near-infrared light absorbing material dispersed in the particle was 842 nm.

Next, 1.0 mass part of a rutile type titania particle (average particle diameter: 20 nm) was externally added as a secondary additive to 100 parts by mass of the obtained particle by a HENSCHEL mixer to obtain an invisible toner (toner B) of Comparative Example 2.

Further, 8 parts by mass of the toner B and 100 parts by mass of the carrier used in Example 1 were mixed in a V-blender to obtain a developer (developer B) of Comparative Example 2. Using the developer B obtained in this manner, an image formation test was made using an image forming device to make various evaluations.

Comparative Example 3

A mixture of toner materials including 60 parts by mass of a linear polyester as a binder resin and 40 parts by mass of a copper phosphoric acid crystallized glass F as a near-infrared light absorbing material was kneaded in an extruder and crushed. Thereafter, the crushed mixture was classified into fine grains and coarse grains by a pneumatic classifier to obtain particles having a volume average particle diameter of 8.5 $\mu$m.

The aforementioned linear polyester was synthesized using terephthalic acid, a bisphenol A-ethylene oxide adduct, a bisphenol A-propylene oxide adduct and cyclohexanedimethanol as raw material and had a glass transition point Tg of 60° C., a number average molecular weight Mn of 3800, a mass average molecular weight Mw of 32000, an acid value of 11 and a hydroxyl value of 23.

Also, the section of the resulting particle was observed by a TEM at a magnification of about 30000, to find that the average dispersion diameter of the near-infrared light absorbing material dispersed in the particle was 355 nm.

Next, 0.7 parts by mass of a rutile type titania particle (average particle diameter: 20 nm) and 0.7 parts by mass of an anatase type titania particle (average particle diameter: 35 nm) were externally added as secondary additives to 100 parts by mass of the obtained particle by a HENSCHEL mixer to obtain an invisible toner (toner C) of Comparative Example 3.

Further, 8 parts by mass of the toner C and 100 parts by mass of the carrier used in Example 1 were mixed in a V-blender to obtain a developer (developer C) of Comparative Example 3. Using the developer C obtained in this manner, an image formation test was made using an image forming device to make various evaluations.

Formation of an Image Using an Image Forming Device

In an image formation test using the invisible toners produced in each example and comparative example, a remodeled machine of DocuColor 1250 (trade name) manufactured by Fuji Xerox Co., Ltd. was used as an image forming device. The image forming device had the same structure as the image forming device 200 shown in FIG. 5 except that the black developing unit 204K was eliminated.

The yellow, magenta and cyan toners used in DocuColor 1250 were applied to the yellow developing unit 204Y, the magenta developing unit 204M and the cyan developing unit 204C respectively. As an image output medium used in the image formation test, an A4 size white paper (P-A4 paper, width: 210 mm and length: 297 mm, manufactured by Fuji Xerox Co., Ltd.) was used.

In an image formation test of each example and comparative example, the developer produced in each of the aforementioned examples and comparative examples was supplied to the invisible developing unit 204F and developers containing yellow, magenta and cyan toners to be used for a visible image formed together with the invisible image were supplied to the yellow developing unit 204Y, the magenta developing unit 204M and the cyan developing unit 204C respectively.

The recorded materials obtained by forming an image on the surface of the image output medium by using the above developers are those in which a visible image and an invisible image are formed on the image forming surface wherein the visible image comprises a document constituted of characters, pictures and the like formed on the whole of the image forming surface.

On the other hand, the aforementioned invisible image comprises a two-dimensional pattern which is formed from two kinds of micro-line bit maps differing in the angle of rotation as shown in FIG. 1, can be mechanically read and decoded and obtained by repeatedly arranging copyright information of 150 bites so as to see the characters "XEROX" with the intention of producing a forgery preventive effect when viewed with the eye, when the invisible image comprising this two-dimensional pattern can be microscopically recognized by glossiness.

It is to be noted that in the image formation test, other than a recorded material (hereinafter abbreviated as "recorded material 1") in which the aforementioned invisible image and visible image were formed on the surface of the image output medium, a recorded material (hereinafter abbreviated as "recorded material 2") in which only the same visible image as in the case of the recorded material 1 was formed on the surface of the image output medium was formed as a reference concurrently.

Evaluation of the Invisible Image and Visible Image Recorded in the Recorded Material In the evaluation of the invisible image and visible image formed on the image forming surface of the recorded material 1, evaluation was made as to the invisible information restoration ratio and the forgery preventive effect in the case of the invisible image and as to the visible image quality in the case of the visible image. Specific evaluation methods and evaluation standard of these characteristics will be explained hereinbelow.

Evaluation of the Invisible Information Restoration Ratio

In the evaluation of the invisible information restoration ratio, the image forming surface of the recorded material 1 was irradiated with a ring-like LED light source (trade name: LEB-3012CE, manufactured by Kyoto Denki K.K.) which emitted light having a wavelength in the near-infrared light region and was disposed at a height of 10 cm almost just above the image forming surface. In this condition, the image forming surface was read by a CCD camera (trade name: CCD TL-C2, manufactured by KEYENCE) which was disposed at a height of 15 cm almost just above the image forming surface, equipped with a filter cutting a wavelength component of 800 nm or less and had light-receiving sensitivity in a wavelength range from 800 nm to 900 nm, to binary-code using, as a boundary, a specified contrast (threshold value) to extract the invisible image, which was then decoded using a software, thereby making evaluation as to whether the copyright information was exactly restored or not. Then, this evaluation was repeated 500 times. The number of the times when the information was exactly restored is shown as the invisible information restoration ratio (%) in Table 2. If the invisible information restoration ratio (%) was 85% or more, it was judged to be practically no problematic level.

Evaluation of the Forgery Preventive Effect

The evaluation of the forgery preventive effect was made in the following manner. Specifically, whether the characters "XEROX" formed as the invisible image could be read or not was judged according to the following standard both in the case of viewing the image forming surface of the recorded material 1 by the eye from a direction (front side)

almost perpendicular to the image forming surface and in the case of viewing the image forming surface of the recorded material 1 from a direction diagonal to a direction perpendicular to the paper surface of the recorded material. The results of evaluation are shown in Table 2.

Strong: the character "XEROX" is not seen when viewing from the front side by the eye, but can be clearly read when viewing from a diagonal direction by the eye and a practically sufficient forgery preventive effect is therefore obtained.

Middle: the character "XEROX" is not seen when viewing from the front side by the eye. However, it is found that some characters are recorded when viewing from a diagonal direction by the eye but it is difficult to read as "XEROX"; however, a practically forgery preventive effect can be obtained.

Weak: the character "XEROX" is not seen when viewing from the front side by the eye, but the existence of the invisible image can be confirmed when viewing from a diagonal direction by the eye and a practically forgery preventive effect is therefore obtained though it is weak.

None: the character "XEROX" is neither seen when viewing both from the front side and from a diagonal direction by the eye nor confirmed as an image noise, and nothing is obtained as a forgery preventive effect.

Evaluation of the Quality of the Visible Image

The quality of the visible image was evaluated by comparing the visible image of the recorded product 1 with the visible image of the recorded product 2 by the eye according to the following standard. The results of evaluation are shown in Table 2.

○: There is no difference in image quality between the visible image of the recorded product 1 and the visible image of the recorded product 2 showing that this is a practically no problematic level.

Δ: As compared with the visible image of the recorded product 2, a slight image noise is confirmed in the visible image of the recorded product 1; however this is practically almost no problematical level.

X: As compared with the visible image of the recorded product 2, a clear image noise is confirmed in the visible image of the recorded product 1, showing that this is practically problematic level.

Evaluation of Absorption Rate

The absorption rate of each of the invisible toners used in the examples and comparative examples in the visible region and a difference in near-infrared light absorption rate between the invisible toner and the visible toner were evaluated as explained below.

Evaluation of the Absorption Rate of the Invisible Toner in the Visible Region

A solid image of the invisible toner was formed on the image output medium used in the examples. The region where this solid image was formed and the surface of the image output medium on which surface nothing was formed as an image were measured a spectral reflectometer as already explained and each spectral reflectance was applied to the formula (2) to find the visible absorption rate of the invisible toner. The maximum visible absorption rate in the visible wavelength region is shown in Table 2.

Evaluation of a Difference in Near-infrared Light Absorption Rate

A difference in near-infrared light absorption rate between the invisible toner and the visible toner was found by measuring a difference in spectral reflectance between the invisible image (solid image) and visible image (solid image), produced using these toners respectively, by using a spectral reflectometer at a wavelength of 860 nm and applying the found difference to the formula (4). The results are shown in Table 2.

TABLE 1

| Near-infrared absorbing material (copper phosphoric acid crystallized glass) | Composition of the copper phosphoric acid crystallized glass (parts by mass) | | | | | | | Average particle diameter (μm) |
|---|---|---|---|---|---|---|---|---|
| | CuO | $Al_2O_3$ | $P_2O_5$ | $K_2O$ | $Na_2O$ | $Li_2O$ | CaO | |
| Copper phosphoric acid crystallized glass A | 38.1 | 5.0 | 53.3 | 3.6 | — | — | — | 6.1 |
| Copper phosphoric acid crystallized glass B | 41.0 | 3.9 | 52.3 | 2.8 | — | — | — | 5.5 |
| Copper phosphoric acid crystallized glass C | 43.3 | — | 53.2 | 2.0 | 1.5 | — | — | 8.0 |
| Copper phosphoric acid crystallized glass D | 58.8 | 7.7 | 31.1 | 1.2 | — | 1.2 | — | 4.9 |
| Copper phosphoric acid crystallized glass E | 22.3 | 1.5 | 68.4 | 5.1 | — | — | 2.3 | 7.2 |
| Copper phosphoric acid crystallized glass F | 62.2 | 3.8 | 33.0 | 1.0 | — | — | — | 4.5 |
| Copper phosphoric acid crystallized glass G | 20.2 | — | 70.4 | 4.2 | 5.2 | — | — | 8.3 |

TABLE 2

| | Invisible toner used | Maximum absorption rate of the invisible toner in the visible region | Average dispersion medium of the near-infrared light absorbing material | Difference in near-infrared light absorption rate at a wavelength of 860 nm | Visible image quality | Restoration ratio of the invisible information | Forgery preventive effect |
|---|---|---|---|---|---|---|---|
| Example 1 | Toner 1 | 1.8% | 320 nm | 31.4% | ○ | 99.8% | Strong |
| Example 2 | Toner 2 | 3.9% | 437 nm | 33.0% | ○ | 99.5% | Strong |
| Example 3 | Toner 3 | 2.5% | 109 nm | 35.9% | ○ | 100% | Middle |
| Example 4 | Toner 4 | 10.0% | 59 nm | 25.2% | Δ | 96.1% | Weak |
| Example 5 | Toner 5 | 8.4% | 525 nm | 18.8% | Δ | 93.7% | Middle |

TABLE 2-continued

| | Invisible toner used | Maximum absorption rate of the invisible toner in the visible region | Average dispersion medium of the near-infrared light absorbing material | Difference in near-infrared light absorption rate at a wavelength of 860 nm | Visible image quality | Restoration ratio of the invisible information | Forgery preventive effect |
|---|---|---|---|---|---|---|---|
| Example 6 | Toner 6 | 3.3% | 330 nm | 15.3% | ○ | 92.4% | Strong |
| Example 7 | Toner 7 | 14.6% | 764 nm | 39.5% | Δ | 100% | Weak |
| Example 8 | Toner 8 | 3.6% | 413 nm | 15.4% | Δ | 85.3% | Strong |
| Comparative Example 1 | Toner A | 1.4% | 47 nm | 23.7% | Δ | 84.4% | None |
| Comparative Example 2 | Toner B | 3.2% | 842 nm | 31.8% | X | 83.5% | None |
| Comparative Example 3 | Toner C | 15.4% | 355 nm | 28.4% | X | 98.5% | Strong |

As is explained above, the invention provides an electrophotographic toner and an electrophotographic developer which make it possible to obtain (1) an invisible image which enables stable mechanical reading and decoding treatment by infrared radiation for a long period of time and information to be recorded at high density, (2) an invisible image which can be formed on a desired region regardless of the position where a visible image is formed on the surface of an image output medium and (3) an invisible image which can be identified by a difference in glossiness when viewed with the eye and can produce a forgery preventive effect without impairing the image quality when a visible image formed together with these invisible images is viewed with the eye, on the surface of the image output medium. The invention also provides an image forming method using these toner and developer and is therefore practically very useful.

What is claimed is:

1. An electrophotographic toner comprising at least a binder resin and a near-infrared light absorbing material consisting of inorganic material particles, wherein the rate of absorption in the visible region of the electrophotographic toner is 15% or less, and the average dispersion diameter of the near-infrared light absorbing material is in a range from 50 nm to 800 nm; and the inorganic material particles are glass obtained by adding at least a transition metal ion.

2. The electrophotographic toner according to claim 1, wherein the binder resin is a resin comprising a polyester as its major component and the near-infrared light absorbing material consists of inorganic material particles comprising at least CuO and $P_2O_5$.

3. The electrophotographic toner according to claim 2, wherein the content of CuO in the inorganic material particles is in a range from 6% by mass to 35% by mass.

4. The electrophotographic toner according to claim 2, wherein the inorganic material particle comprises a copper phosphoric acid crystallized glass containing CuO, $Al_2O_3$, $P_2O_5$ and $K_2O$ as its essential structural components.

5. The electrophotographic toner according to claim 4, wherein the copper phosphoric acid crystallized glass has a composition in which the content of CuO is in a range from 20% by mass to 60% by mass, the content of $Al_2O_3$ is in a range from 1% by mass to 10% by mass, the content of $P_2O_5$ is in a range from 30% by mass to 70% by mass and the content of $K_2O$ is in a range from 1% by mass to 10% by mass.

6. The electrophotographic toner according to claim 1, wherein a maximum absorption rate of the toner in a wavelength ranging from 400 nm to 600 nm is 8% or less.

7. The electrophotographic toner according to claim 1, wherein a maximum absorption rate of the toner in a wavelength ranging from 600 nm to 700 nm is 10% or less.

8. The electrophotographic toner according to claim 1, wherein the average dispersion diameter of the near-infrared light absorbing material consisting of inorganic material particles is in a range from 100 nm to 600 nm.

9. An electrophotographic developer comprising a carrier and an electrophotographic toner, wherein the electrophotographic toner comprises:

at least a binder resin and a near-infrared light absorbing material consisting of inorganic material particles, wherein the rate of absorption in the visible region of the electrophotographic toner is 15% or less, and the average dispersion diameter of the near-infrared light absorbing material is in a range from 50 nm to 800 nm; and the inorganic material particles are glass obtained by adding at least a transition metal ion.

10. The electrophotographic toner according to claim 9, wherein the binder resin is a resin comprising a polyester as its major component, and the near-infrared light absorbing material consists of inorganic material particles comprising at least CuO and $P_2O_5$.

* * * * *